US005579547A

United States Patent [19]

Hunt

[11] Patent Number: 5,579,547

[45] Date of Patent: Dec. 3, 1996

[54] PATIENT LIFT-TRANSFER MECHANISM FOR GURNEY

[76] Inventor: Dermot A. Hunt, 250 Fairfield Ct., Palatine, Ill. 60067

[21] Appl. No.: 518,482

[22] Filed: Aug. 23, 1995

[51] Int. Cl.[6] ..... A61G 7/10; A61G 7/14

[52] U.S. Cl. ..... 5/86.1; 5/83.1; 5/87.1

[58] Field of Search ..... 5/86.1, 87.1, 83.1, 5/84.1, 85.1, 89.1, 81.1 R

[56] References Cited

U.S. PATENT DOCUMENTS

| | | | |
|---|---|---|---|
| 2,418,606 | 4/1947 | Smith | 5/86.1 |
| 5,147,051 | 9/1992 | Liljedahl | 5/81.1 |
| 5,163,189 | 11/1992 | Degray | 5/86.1 |
| 5,185,894 | 2/1993 | Bastert et al. | 5/81.1 |
| 5,239,713 | 8/1993 | Toivio et al. | 5/83.1 |
| 5,390,380 | 2/1995 | James-Wallace | 5/87.1 |

*Primary Examiner*—Alexander Grosz

*Attorney, Agent, or Firm*—Charles F. Lind

[57] ABSTRACT

The disclosed lift/transfer mechanism has a pair of boom arms pivoted at two end corners to a patient gurney, the arms being of sufficient height and length to move the free arm ends to operative positions over the top of the gurney and an adjacent transfer support. A lift strap is dangled from each boom arm to an underlying hook for making a connection to the patient board. Each lift strap is routed via pathways in its respective boom arm to a winch carried on the gurney near the boom arm pivot structure, and the lift strap is released or retracted by winch operation to raise and lower the patient board and suspend it from the boom arms. Boom arm rotation between the operative positions shifts the suspended patient board laterally between the gurney and transfer support. Strap slides moveable freely along the boom arms route the lift straps to keep them hanging vertically between the boom arms and underlying hooks, for maintaining substantially constant patient board height during this lateral transfer.

10 Claims, 2 Drawing Sheets

PATIENT LIFT-TRANSFER MECHANISM FOR GURNEY

BACKGROUND OF THE INVENTION

Gurneys are used in hospitals and medical or health care facilities to transport patients about, commonly while lying flat out and on the way to or from treatment or examination centers. Thus, a patient scheduled for an operation, would be carried by gurney from the patient's room to the operating room and then from the operating room via a recovery room back the patient's room. The patient must be transferred from the patient's bed to the gurney and then the operating table before the operation, and the reverse again after the operation, and such transfers traditionally have been made manually.

Many times, the patient is unconscious or otherwise is incapable of offering assistance in the transfer, so that great physical effort might be needed to lift and laterally shift the patient between the gurney and the bed or table located next to and generally aligned side-by-side with the gurney. Although only one orderly is needed to roll the gurney about the facility, several orderlies might then be needed for each manual transfer, adding to staff demands. Further, three or more orderlies might even be needed for a manual transfer if a significant mismatch in patient's weight versus orderly strength exists.

Moreover, injury risks of the orderly are increasingly of concern because of inflating cost for staff insurance and/or compensation liability, and because the potential of injury are high due to the awkward or improperly leveraged orderly movements needed for the patient transfer.

Mobile lifts, suited to be moved next to the bed, gurney or operating table, etc. on which the patient is supported, are available and have sling means that can be connected to the patient and then lifted under power for transferring the patient between the adjacent supports. However, such lifts are primarily used only for transferring the patient, and actually contain the patient for only a short duration and only at the transfer site. Thus, a different lift must be present at each transfer site, or the same lift moved between such sites along with the patient on the gurney. The need for different types of equipment at the facility increases the overall cost and space or inventory requirements of the facility.

SUMMARY OF THE INVENTION

This invention relates to a patient gurney, and specifically to a patient lift/transfer mechanism usable thereon.

A basis object of this invention is to provide a patient lift/transfer mechanism suited for permanent mounting on an otherwise generally conventional gurney for allowing a patient to be lifted and transferred between the gurney and an adjacent bed or operating table, etc. support, where an orderly need not lift the patient but only roll the patient onto or off of the transfer mechanism, thereby allowing most transfers to be completed by only one orderly.

Another object of this invention is to provide a patient board suited to serve both as part of a lift/transfer mechanism for easily moving the patient about the facility, but also suited to follow the patient and support the patient during medical procedures at the facility.

Another object of this invention is to provide a gurney with a lift/transfer mechanism that incorporates and satisfies the combined features of the previous objects, while reducing the inventory needs of equipment at the facility.

The disclosed lift/transfer mechanism can include a patient board, separably coupled to the mechanism, on which the patient could lie flat out. Two boom arms respectively mounted at two adjacent corners of the gurney, along one long side edge near the foot and head ends thereof, can be rotated about vertical axes. The boom arms curve to horizontally extended free ends that overlie with vertical clearance the lateral center of the top gurney surface and patient board thereon, and over any patient on the patient board. A strap slide is guided to move freely along each boom arm free end, and a lift strap is routed from one end connection to each boom arm, via rolls on the strap slide and patient board, to an opposite end connection on a reversible electrically powered winch. Winch operation lifts and lowers the patient board vertically as needed, including for suspending it from the boom arms. With the patient board suspended, boom arm rotation laterally shifts the board between opposite operative positions respectively overlying the gurney top surface or adjacent transfer surface comprised as the patient's bed, operating table, etc. The lift straps hang vertically between the strap slides and underlying patient board, and movement of the strap slides along the boom arms keeping the suspended patient board height constant during this transfer. Batteries carried on the gurney can power the winch for lift/transfer mechanism operation anywhere. Outriggers on the gurney can be extended laterally to rest against the floor under the transfer bed, table, etc. for stabilizing against laterally off-center patient suspension loads.

BRIEF DESCRIPTION OF THE DRAWINGS

These and other objects, features or advantages of the invention will be more fully understood and appreciated after consideration of the following description of the invention, which includes as a part thereof the accompanying drawings, wherein.

DETAILED DESCRIPTION OF PREFERRED EMBODIMENTS OF THE INVENTION

Figure 1:
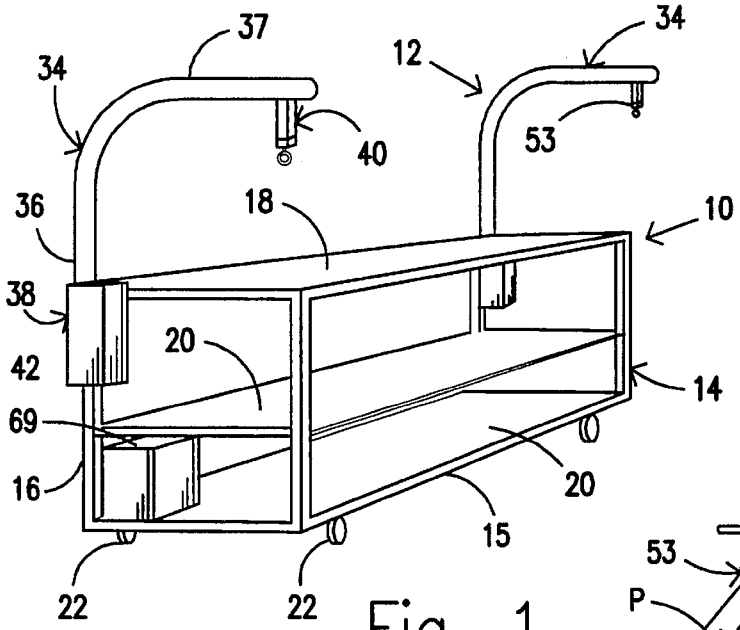
FIG. 1 is a perspective view of a gurney, shown empty, with the subject lift/transfer mechanism incorporated therein.

The invention disclosed herein is embodied in a patient gurney 10, and specifically relates to a patient lift/transfer mechanism 12 usable thereon. The gurney 10 can be of generally conventional design, having a frame 14 of structural horizontal and vertical members 15 and 16, a top surface 18 of generally rectangular shape having four corners 19, intermediate and lower shelfs 20, and wheels 22. The wheels 22 would swivel about vertical axes and rotate about horizontal axes, for steering and rolling the gurney along a floor 23, and could have appropriate conventional manual and/or remote braking mechanisms (not shown). The top gurney surface 18 would be large enough to allow average size patients to be carried thereon, generally while lying flat.

Figure 4:
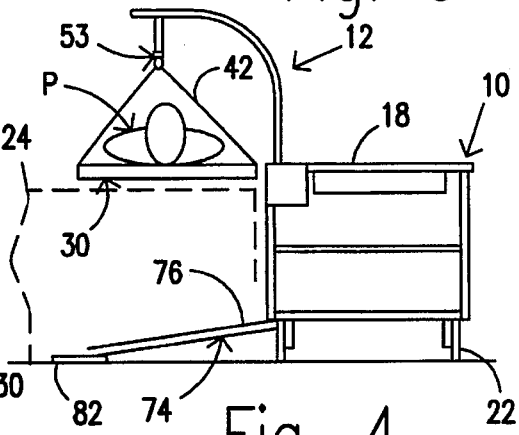
FIG. 4 is an end elevational view similar to FIG. 3, except showing the lift/transfer mechanism in a different laterally shifted operative position suited for patient transfer to or from an associated adjacent transfer surface shown in phantom next to the gurney.

The lift/transfer mechanism 12 would be suited to lift and transfer a patient "P" from the gurney 10 to an adjacent bed or operating table 24 (shown in phantom only in FIGS. 4 and 5), and vice versa, where the orderly need not lift the patient but only roll the patient onto and/or off of the transfer mechanism, thereby allowing most transfers to be completed by only one orderly.

The lift/transfer mechanism 12 uses a separate patient board 30 on which the patient "P" would be positioned, instead of on the gurney top surface 18, and the board would also be of generally rectangular shape having long side edges 32 and short end edges 33, and would be just slightly smaller than the gurney top surface 18, suited to carry most patients thereon, generally while lying flat out. The patient board 30 would be supported on the top gurney surface 18 when on the gurney 10.

Figure 6:
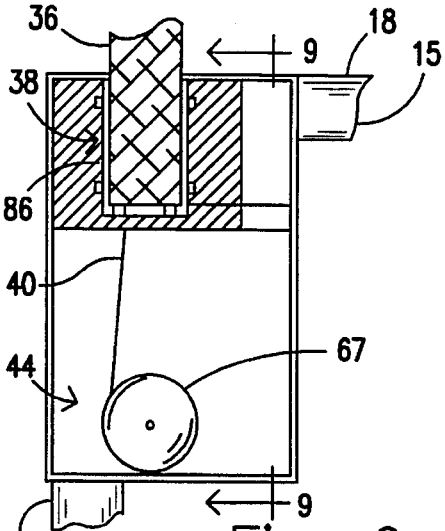
FIG. 6 is an end sectional view, enlarged compared to the previous figures, of the lower end of a boom arm used in the lift/transfer mechanism.
Figure 9:
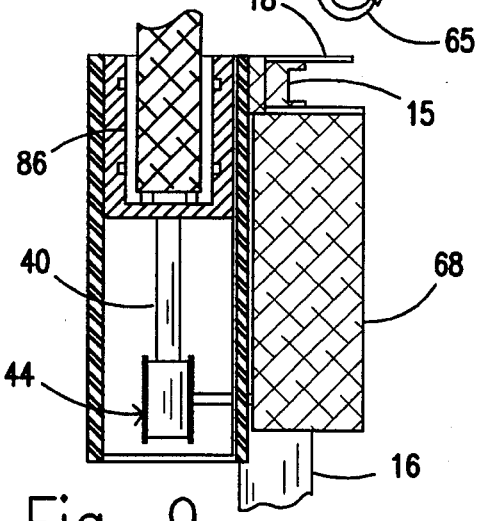
FIG. 9 is a sectional view as taken generally from line 9—9 in FIG. 6.

The illustrated lift/transfer mechanism 12 has two boom arms 34 mounted to swivel from the gurney 10 along one of its long sides near adjacent respective foot and head end corners thereof. The arms 34 are curved between generally straight end sections 36 and 37, the lower end section 36 being vertically aligned at mounting means 38, and the opposite free end section 37 being horizontally aligned and spaced well above the top gurney surface 18. Flexible lift straps 40 and 42 releasibly connect the boom arms 34 relative to the underlying patient board 30. A drive winch 44 (see FIGS. 6 and 9) associated with each boom arm releases or retracts each lift strap 40, to raise or lower the patient board 30 relative to the boom arms 34 and/or gurney 10, including for suspending the patient board from the boom arms 34.

As FIGS. 6–9 show, each boom arm 34 has an elongated upper pathway 46 extended over its full length and a lower pathway 48 extended at least in the end section 37. The lower pathway 48 is comprised of spaced lower ledges 49 formed on opposite sides of an elongated slot 50 wide enough to have the strap 40 freely fit through it. Strap slide 52 is guided along each boom arm end 37 within the lower pathway 48. The strap 40 is routed within both the boom arm pathways 46 and 48, and is redirected around the strap slide 52 and through the slot 50 as loop 51 to a hook assembly 53 located outside of the boom arm, suited for connection to the strap 42.

The strap slide 52 is illustrated as a wheeled car having two spaced axles 54, each axle in turn supporting two wheels 55 suited to roll along the ledges 49 and a roller 56 suited to rotate independently of the wheels for guiding the strap 40. Rollers 58 and 59 are mounted in each boom arm on opposite ends of the slot 50, roller 58 at the common ends of the pathways 46 and 48, and roller 59 within boom arm pathway 48.

The strap 40 is routed within upper pathway 46 from one end connection at power winch 44 near the mounted end 36 of each boom arm to and around rollers 58 and 59 and back to the strap slide 52, passing over rollers 56 and a roller 61 carried in the hook assembly 53, and then to end connection 64 in the boom arm. A snap hook 65 on the hook assembly can make a releasible connection to eyelets 66 on the ends of patient board strap 42.

Each winch 44 has a spool 67 preferably driven by a reversible electrically powered motor drive or the like, to store the strap 40 and retract or release it to shift the patient board vertically to different heights relative to the gurney top surface 18 or spacings below the horizontal boom arm end sections 37. A battery 69 carried on the gurney 10 can electrically power each winch 44 for providing lift/transfer mechanism operation anywhere the gurney can go. The winches in the separate boom arms can be activated simultaneously by common directional and on-off switches contained on a gurney panel 71 or in a portable hand control (not shown).

Figure 5:
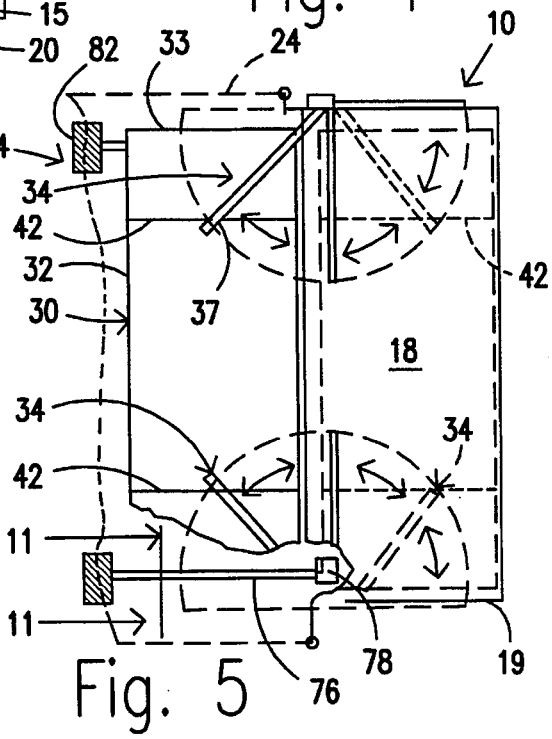
FIG. 5 is a top plan view of the gurney and lift/transfer mechanism of FIG. 4, with the associated transfer surface.
Figure 11:
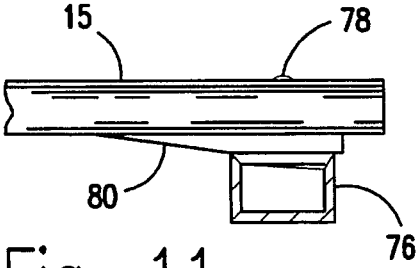
FIG. 11 is an enlarged sectional view as taken generally from line 11—11 in FIG. 5, of stabilizer structure used on the gurney.
Figure 7:
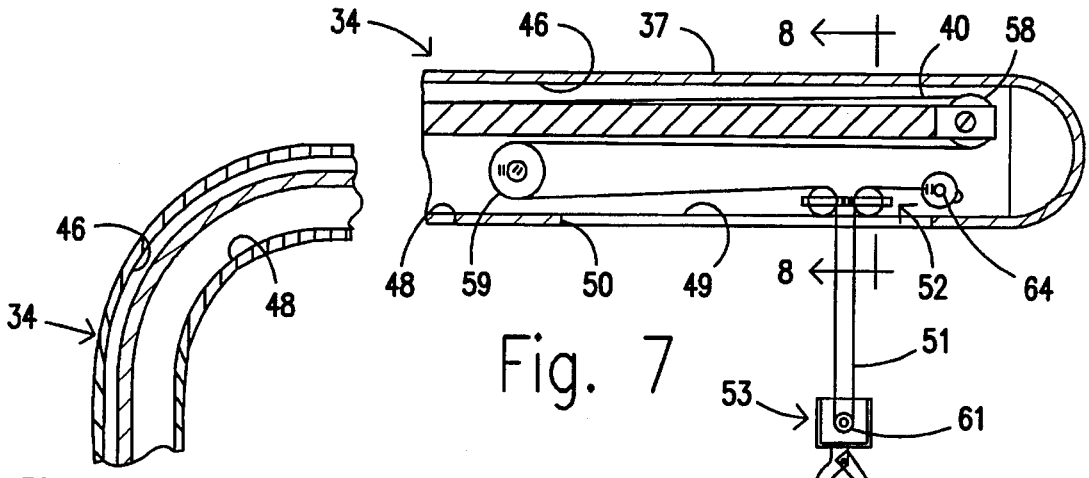
FIG. 7 is a central sectional view, enlarged compared to the adjacent FIG. 6, of the upper end of a boom arm used in the lift/transfer mechanism.

Each boom arm end section 37 is sufficiently long to overlie the approximate lateral center of the gurney top surface 18, and the adjacent transfer surface 24 located side-by-side with the gurney 10. Two such operative positions of the boom arms 34 are illustrated in FIG. 5: in phantom with the free ends 37 being angled inwardly over the gurney top surface 18, and in solid with the free ends being angled outwardly away and spaced from the gurney top surface and over the adjacent transfer surface 24.

The straps 42 are provided at locations along the patient board 30 to underlie the strap slide 52 and/or hook assembly 53 with the boom arms 34 in the operative position overlying the gurney top surface 18. Once set, the separation along the patient board 30 between the straps 42 will typically remain constant. The patient board straps 42 can be easily connected by hook assembly 53 to the strap 40, and should the winch 44 be activated to shorten the effective strap 40 to elevate the patient board 30 and suspend it from the boom arms, the strap loop 51 will extend substantially vertically.

With the patient board 30 so suspended, boom arm rotation can laterally shift the patient board between opposite operative positions respectively overlying the gurney top surface 18 or adjacent transfer surface 24. However, the strap slides 52 can roll along the boom arm end sections 37 to correspond to and remain the same as the separation of the board straps 42 along the patient board 30, so that each strap loop 51 will generally remain vertically aligned during this transfer. This keeps the vertical patient board height or spacing from the boom arm substantially constant during this transfer.

By contrast, when the drive winches 44 are operated, the overall height of the patient board 30 is raised or lowered by reeling in on or releasing the lift straps 40 from the spools 67. Winch operation thus sets the overall height of the patient board, to correspond to either the gurney top surface 18 of transfer surface 24 or to be lifted above them for the lateral transfer from one to the other.

Figure 3:
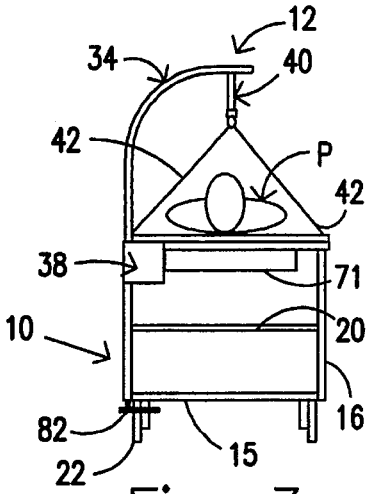
FIG. 3 is an end elevational view of the gurney and lift/transfer mechanism of FIG. 2.
Figure 2:
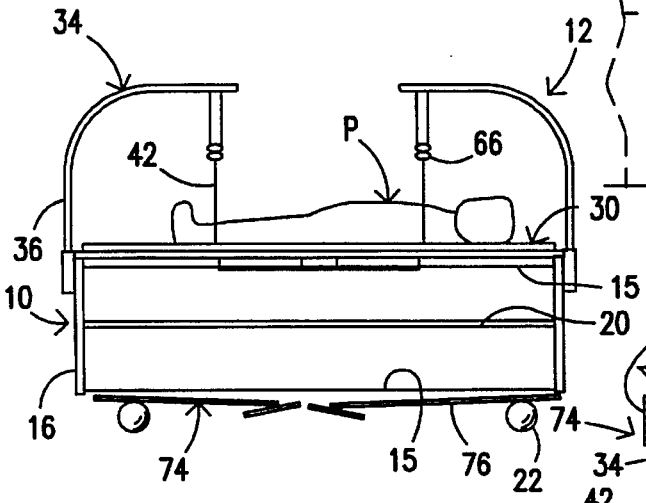
FIG. 2 is a side elevational view of the gurney and the lift/transfer mechanism, except in a different operative position and with a patient positioned thereon.

Outriggers 74 can be carried on the underside of gurney 10 suited to be shifted between stored positions (FIGS. 1–3) under the lower shelf 20 and operative deployed positions (FIGS. 4–6) projected laterally of the gurney for stabilizing the off-center gurney loads occasioned during the transfer of a suspended patient. Each outrigger 74 can include an arm 76 pivoted off of the gurney framing 15 at substantially vertical pivot 78, near the gurney ends and sides of and below the boom arms mountings 38, with a support foot 82 on the end of each arm for resting against the floor 23.

While the outrigger arms swing in a generally horizontal plane through most the arc traversed between the stored and deployed positions, a cam 80 in the pivot structure 78 can wedge the arm out of this plane to be slightly inclined downwardly toward the floor when deployed, for planting the foot 82 firmly against the floor. The pivot structures 78 will be spaced apart a distance less than the leg separation (not shown) of the transfer bed, table, etc. comprising the transfer surface 24, to allow the outriggers to fit therebetween when deployed and when the gurney and transfer structures are in the adjacent side-by-side transfer relationship (FIG. 5).

Preferred straps 40 and 42 would be durable, flexible and nonextendable, such as of nylon webbing or the like. The straps 42 can be connected to the patient board by conventional quick release hooks cooperating with appropriately located receiving openings (neither being shown) provided along the board. Conventional patient securing straps (not shown), similar to such provided on a conventional gurney and/or patient stretcher, could be provided on the board for added patient safety and security.

Different types of patient boards 30 could be provided for use in specific departments of a medical facility. For example, the patient board could be padded or unpadded, could be made to sterilized standards and sealed in packages suited when opened for sterile operation rooms, or could be made of materials suited for X-rays, imaging or therapy. The boards or wrappings could be color coded, and a number of such patient boards could be carried about on the gurney, on the shelf 20 for example, and after use could be cleaned, repackaged and reused.

A patient thus could be placed on the board 30 at the patient's room and moved via the gurney 10 to a specific medical department for treatment, examination, tests, surgery, etc. or the like, which might take place with the patient still on the board, and the patient could be returned to the patient's room without ever leaving the board.

The boom arms 34 can be aluminum extrusions, with the defined pathways, straight end sections and intermediate bend. A cylindrial block 86 can be fitted over the irregular cross section of each boom arm for accommodating rotatable mounting 38. Stops (not shown) could limit boom arm rotation to approximately 180 degrees, with the boom arm end section 37 being generally aligned with the gurney end in the opposite positions.

The patient board 30 could be shifted laterally to rotate the freely rotatable boom arms 34, or a suitable drive could be used to rotate the boom arms for laterally shifting the patient board. Thus, bevel gear 145 (FIG. 10) might be secured to the mounting block 186, and a pinion 146 engaged with the bevel gear could be rotated by a hand crank or motor drive (neither being shown) to provide powered boom arm rotation, which in turn would laterally shift the suspended patient board.

The vertical height of the end section 37 above the gurney top surface 18 might be approximately 20–30 inches, the circular reach of the end section 37 and hook assembly 53 from boom arm mounting 38 might be approximately 25–35 inches, and the travel of the strap slide 52 might be approximately 8–12 inches.

Safety controls can be implemented in the lift/transfer mechanism on the gurney, such as an interlock that would preclude operating of the lifting winch 44 unless the outriggers 74 have been deployed. Also, a low charge battery alarm or a patient overload alarm could be provided.

Figure 10:
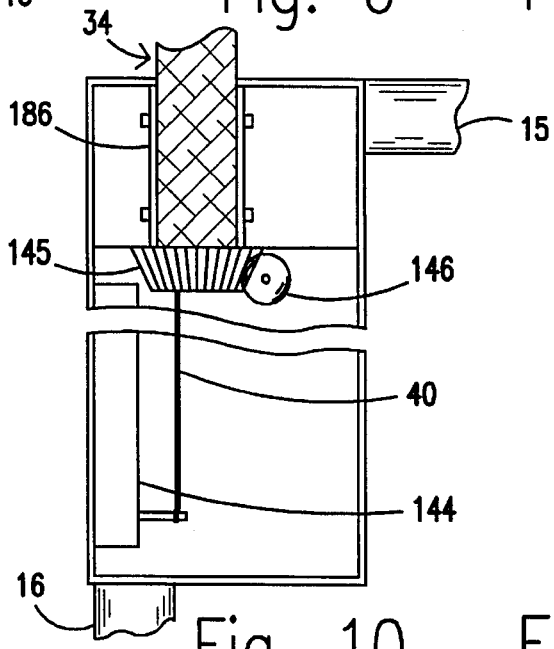
FIG. 10 is an end sectional view, similar to FIG. 6, except of an alternative drive for the transfer mechanism.
Figure 8:
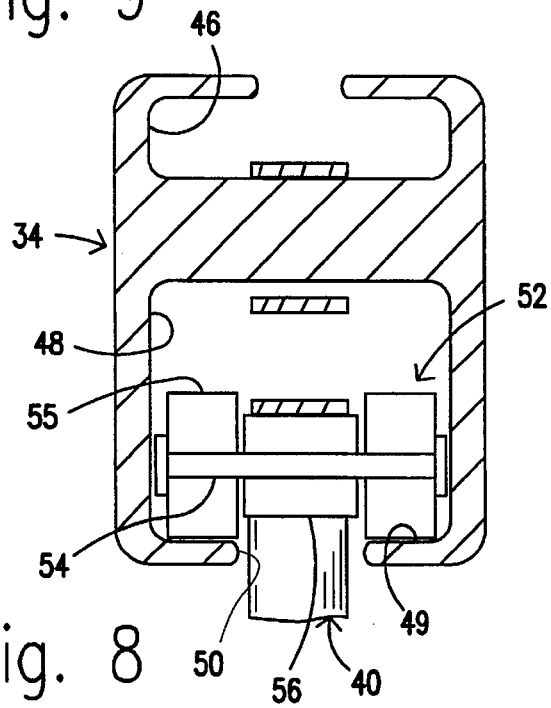
FIG. 8 is an enlarged sectional view as taken generally from line 8—8 in FIG. 7.

An alternative lifting mechanism for the lift strap 40 might include a linear motor 144 (FIG. 10).

A suitable hand crank drive (not shown) might be provided instead of the powered winch 44 or linear motor 144, for manual operation by the orderly.

While a specific embodiment has been illustrated, it will be obvious that minor changes could be made therefrom without departing from the spirit of the invention. Accordingly, the invention is to determined by the scope of the following claims.

What is claimed is:

1. For a gurney having side edges terminating near spaced corners, and corner wheels movably supporting the gurney, an improved patient lift/transfer mechanism for shifting a patient between the gurney and an adjacent transfer structure disposed side-by-side next to the gurney, comprising a patient board suited for carrying a patient and be removably supported on a gurney top surface, a pair of boom arms each having generally straight lower and upper end sections angled relative to one another, and means mounting the boom arms at corresponding lower end sections to the gurney near the corners on one side edge operable to have the corresponding upper end sections moveable between one operative position angled to vertically overlie the gurney top surface, patient board and any patient thereon, and another operative position angled away from the gurney top surface and to vertically overlie the adjacent transfer structure, flexible nonextendable lift straps and means for releasibly connecting the lift straps to the patient board, and lift means for releasing and retracting said lift straps suited when operated to raise and lower the patient board to different suspended spacings below the upper boom arm end sections and above the gurney top surface and transfer structure, and said boom arms near the mounting means being laterally spaced apart sufficiently to pass the patient board horizontally therebetween, whereupon boom arm rotation between said operative positions laterally shifts the suspended patient board and any patient thereon between the same operative positions.

2. A patient lift/transfer mechanism according to claim 1, further wherein the lift means comprise strap slides freely moveable along the boom arms upper end sections, operable to suspend the lift straps substantially vertically between the strap slides and the underlying patient board and keep the height of the suspended patient board constant upon boom arm rotation between the operative positions.

3. A patient lift/transfer mechanism according to claim 1, further wherein the lift means comprise winch means for the lift straps and means supporting the winch means relative to the gurney near the boom arms mounting means.

4. A patient lift/transfer mechanism according to claim 3, further comprising electric motor drive means for operating the winch means, and an electric battery carried on the gurney for powering the motor drive means at any gurney location.

5. A patient lift/transfer mechanism according to claim 1, further comprising the boom arms having upper and lower pathways, said lift means including strap slides mounted to move along the upper boom arm end sections in the lower pathway, the lift strap being extended through the boom arm pathways and over the strap slide to outside of the boom arm toward the patient board, and means to connect the lift strap to the underlying patient board.

6. A patient lift/transfer mechanism according to claim 1, further comprising outriggers carried on the underside of the gurney suited to be shifted between stored positions and deployed positions projected laterally of the gurney and against an underlying supporting floor under the transfer support for stabilizing off-center gurney loads occasioned during the patient transfer.

7. A patient lift/transfer mechanism according to claim 6, further comprising each outrigger having an arm and structures near the gurney ends on the side below the boom arms mountings for pivoting the inboard end of the arm to swing about a substantially vertical axis, a support foot on the outboard end of each arm for resting against the floor, and the pivot structures being spaced apart a distance to fit the arms when deployed between support legs for the transfer structure.

8. A patient lift/transfer mechanism according to claim 1, further comprising having a plurality of different types of patient boards for different specific uses, including padded or unpadded patient boards, sterilized and sealed patient boards suited for sterile operation room use, and color coded patient boards or packages therefor, and a shelf on the gurney to carry such patient boards.

9. A patient lift/transfer mechanism according to claim 1, further comprising each boom arm having upper and lower pathways meeting at a common end opposite from the mounting means, the lift means including a strap slide mounted to move along each upper boom arm end section in the lower pathway and having spaced roll means, the lift strap being extended through the boom arm including via the upper pathway from one end adjacent the mounting means to and over first roller means between the pathways at the common end and past the strap slide in the lower pathway to and over second roller means spaced from the first roller means and back to and over the strap slide roll means to third roller means on an exterior hook assembly to a connection near the other boom arm end, said lift strap hanging vertically between the strap slide and underlying hook assembly, and a hook on the hook assembly for making a releasible connection to the patient board.

10. A patient lift/transfer mechanism according to claim 9, further comprising said lift means including a winch at said one strap end for releasing and retracting the strap relative to the boom arm for adjusting the height of the underlying suspended patient board, electric motor means for powering the winch, and an electric battery carried on the gurney for powering the electric motor means at any gurney location.

* * * * *